US009963203B1

(12) United States Patent
Brosenitsch et al.

(10) Patent No.: US 9,963,203 B1
(45) Date of Patent: May 8, 2018

(54) FLOATING SUPPORT STRUCTURE FOR SUPPORTING A COVER OF A BODY OF WATER

(71) Applicants: Andrew Brosenitsch, Cabot, PA (US); Matthew Brosenitsch, Cabot, PA (US)

(72) Inventors: Andrew Brosenitsch, Cabot, PA (US); Matthew Brosenitsch, Cabot, PA (US)

( * ) Notice: Subject to any disclaimer, the term of this patent is extended or adjusted under 35 U.S.C. 154(b) by 0 days. days.

(21) Appl. No.: 15/429,837

(22) Filed: Feb. 10, 2017

(51) Int. Cl.

| | |
|---|---|
| ***B63B 1/14*** | (2006.01) |
| ***E04H 4/00*** | (2006.01) |
| ***E04H 4/08*** | (2006.01) |
| ***E02B 1/00*** | (2006.01) |
| ***B63B 35/00*** | (2006.01) |
| ***B63B 17/02*** | (2006.01) |
| ***B63B 21/50*** | (2006.01) |
| ***B63B 7/02*** | (2006.01) |
| *B63B 7/00* | (2006.01) |

(52) U.S. Cl.
CPC ..... *B63B 1/14* (2013.01); *B63B 7/02* (2013.01); *B63B 17/02* (2013.01); *B63B 21/50* (2013.01); *B63B 35/00* (2013.01); *E02B 1/00* (2013.01); *E04H 4/00* (2013.01); *E04H 4/08* (2013.01); *B63B 2001/145* (2013.01); *B63B 2007/003* (2013.01)

(58) Field of Classification Search
CPC .... E04H 4/00; E04H 4/06; E04H 4/08; E04H 4/10; E04H 3/16; E04H 3/18
USPC ..... 4/498, 499, 503; 114/267
See application file for complete search history.

(56) References Cited

U.S. PATENT DOCUMENTS

| | | | | |
|---|---|---|---|---|
| 3,355,745 | A | 12/1967 | Jannuzzi | |
| 3,769,639 | A * | 11/1973 | Bishop | E04H 4/106 4/498 |
| 5,116,005 | A * | 5/1992 | Lagoy | G10G 5/00 248/168 |
| 5,259,077 | A | 11/1993 | Hager et al. | |
| 5,371,907 | A | 12/1994 | Horvath | |
| 6,119,284 | A | 9/2000 | Cosman | |

* cited by examiner

*Primary Examiner* — Lars A Olson

(57) ABSTRACT

Disclosed is a floating support structure for supporting a cover of a body of water. In an aspect, the floating support structure includes at least three legs, each leg of the at least three legs having a first terminal end and a second terminal end opposite the first terminal end, a hub coupled to the first terminal end of each leg of the at least three legs, and at least three floatation devices, wherein each floatation device of the at least three floatation devices is coupled to the second terminal end of a leg of the at least three legs. In an aspect, the hub may be configured to receive a terminal end of at least one interconnection rod, and the at least one interconnection rod may be configured to couple the floating support structure to a second floating support structure.

20 Claims, 11 Drawing Sheets

FLOATING SUPPORT STRUCTURE FOR SUPPORTING A COVER OF A BODY OF WATER

BACKGROUND

1. Field of the Disclosure

Aspects of the present disclosure relate to a floating support structure for supporting a cover of a body of water.

2. Description of the Related Art

Small man-made ponds, streams, and waterfalls are a beautiful landscaping feature. However, such landscape water features require maintenance. For example, organic debris, such as leaves, twigs, and the like, often fall into these waterways, especially during the fall and winter months in certain geographic areas. To address this issue, owners or operators will often position protective netting over landscape water feature during the fall and winter months.

The simplest method is to simply stretch the protective netting over the surface of the landscape water feature, anchoring the netting to the ground outside of the edges of the waterway. However, this method has several drawbacks. For example, excessive amounts of debris can accumulate on the netting, creating a heavy downward pressure on the netting and causing it to sag below the surface of the water. This buildup of debris in the waterway can result in improper net aeration (e.g., due to portions of the netting being underwater), breaches within the moving water courses (e.g., clumps of debris diverting streams, waterfalls, etc.), poor water quality (e.g., due to decomposing organic debris), and damage to the protective netting itself (e.g., tears from the weight of the debris).

To address these issues, another method is to stretch the protective netting over a frame erected over the water feature. While such frames may successfully keep the netting out of the water, they are difficult to set up. For most designs, the frame is assembled in-place over the water feature, typically with the legs of the frame placed outside the edge of the waterway, and then the protective netting is stretched over the frame and anchored to either the frame or, more commonly, the outside edge of the waterway.

Accordingly, there is a need for an improved method and support structure for covering a body of water with a protective cover.

SUMMARY

The following presents a simplified summary relating to one or more aspects disclosed herein. As such, the following summary should not be considered an extensive overview relating to all contemplated aspects, nor should the following summary be regarded to identify key or critical elements relating to all contemplated aspects or to delineate the scope associated with any particular aspect. Accordingly, the following summary has the sole purpose to present certain concepts relating to one or more aspects relating to the mechanisms disclosed herein in a simplified form to precede the detailed description presented below.

Disclosed is a floating support structure for supporting a cover of a body of water. In an aspect, the floating support structure includes at least three legs, each leg of the at least three legs having a first terminal end and a second terminal end opposite the first terminal end, a hub coupled to the first terminal end of each leg of the at least three legs, and at least three floatation devices, wherein each floatation device of the at least three floatation devices is coupled to the second terminal end of a leg of the at least three legs.

Also disclosed is a system for supporting a cover of a body of water. In an aspect, the system may include a first floating support structure, the first floating support structure comprising: a first set of at least three legs, each leg of the first set of at least three legs having a first terminal end and a second terminal end opposite the first terminal end, a first hub coupled to the first terminal end of each leg of the first set of at least three legs, wherein the first hub is configured to receive a first terminal end of at least one interconnection rod, and a first set of at least three floatation devices, wherein each floatation device of the first set of at least three floatation devices is coupled to the second terminal end of a leg of the first set of the at least three legs; a second floating support structure, the second floating support structure comprising: a second set of at least three legs, each leg of the second set of at least three legs having a first terminal end and a second terminal end opposite the first terminal end, a second hub coupled to the first terminal end of each leg of the second set of at least three legs, wherein the second hub is configured to receive a second terminal end of the at least one interconnection rod, and a second set of at least three floatation devices, wherein each floatation device of the second set of at least three floatation devices is coupled to the second terminal end of a leg of the second set of the at least three legs; and the at least one interconnection rod, wherein the first terminal end of the at least one interconnection rod is configured to couple to the first hub of the first floating support structure and the second terminal end of the at least one interconnection rod is configured to couple to the second hub of the second floating support structure.

Also disclosed is a hub of a floating support structure for supporting a cover of a body of water. In an aspect, the hub includes a top surface configured to support the cover of the body of water, a bottom surface configured to receive a first terminal end of each leg of at least three legs, and at least three channels, each channel of the at least three channels having an opening in the bottom surface of the hub, wherein each channel of the at least three channels is configured to receive a leg of the at least three legs, wherein the hub is configured to allow the at least three legs to move between an open position and a closed position of the floating support structure.

Other objects and advantages associated with the aspects disclosed herein will be apparent to those skilled in the art based on the accompanying drawings and detailed description.

BRIEF DESCRIPTION OF THE DRAWINGS

The accompanying drawings are presented to aid in the description of various aspects of the disclosure and are provided solely for illustration of the aspects and not limitation thereof.

DETAILED DESCRIPTION

Figure 1:
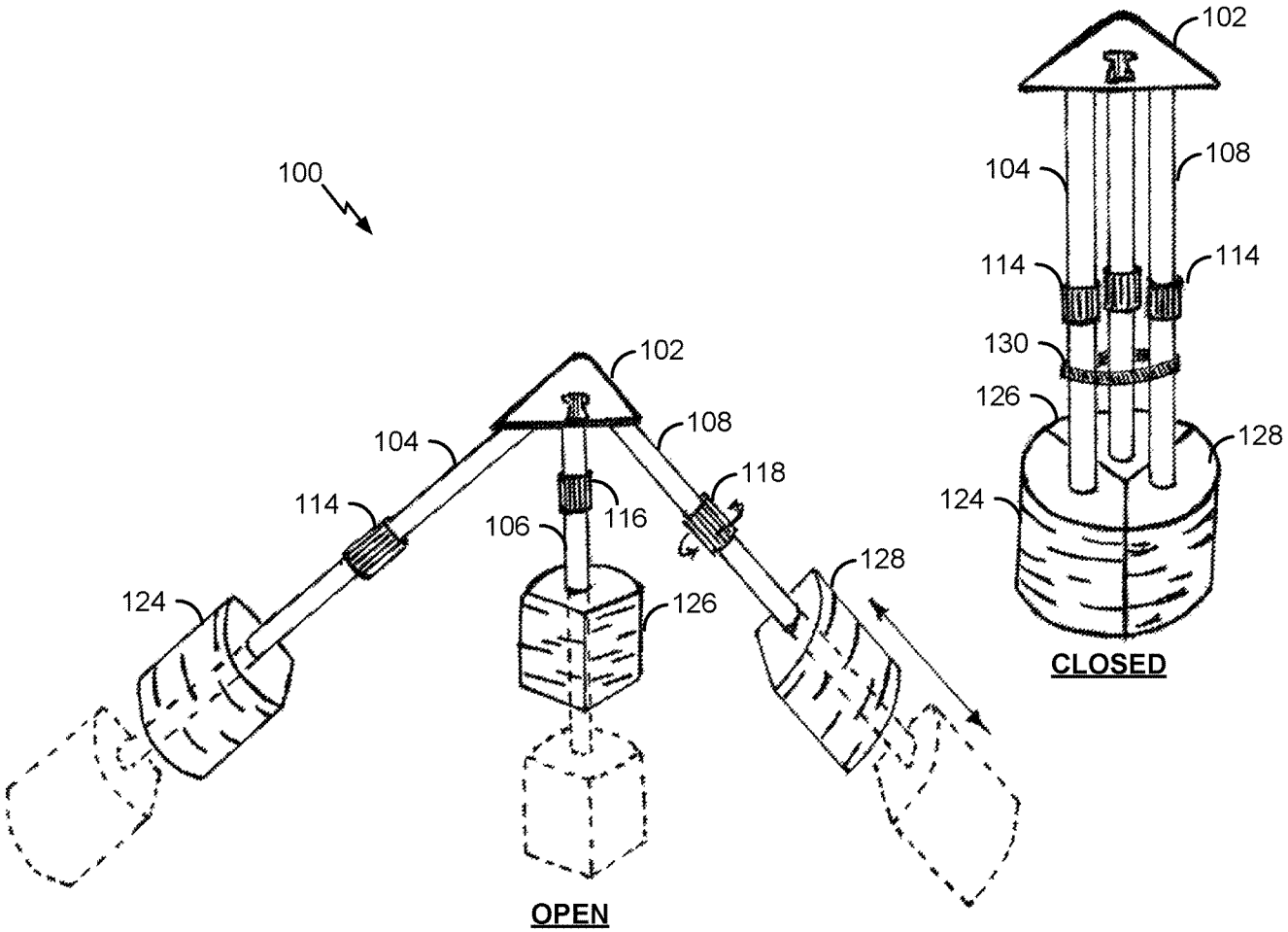
FIG. 1 illustrates an exemplary floating support structure according to at least one aspect of the disclosure.

Disclosed is a floating support structure for supporting a cover of a body of water. In an aspect, the floating support structure includes at least three legs, each leg of the at least three legs having a first terminal end and a second terminal end opposite the first terminal end, a hub coupled to the first terminal end of each leg of the at least three legs, and at least three floatation devices, wherein each floatation device of the at least three floatation devices is coupled to the second terminal end of a leg of the at least three legs. In an aspect, the hub may be configured to receive a terminal end of at least one interconnection rod, and the at least one interconnection rod may be configured to couple the floating support structure to a second floating support structure.

More specific aspects of the disclosure are provided in the following description and related drawings directed to various examples provided for illustration purposes. Alternate aspects may be devised without departing from the scope of the disclosure. Additionally, well-known aspects of the disclosure may not be described in detail or may be omitted so as not to obscure more relevant details.

The words "exemplary" and/or "example" are used herein to mean "serving as an example, instance, or illustration." Any aspect described herein as "exemplary" and/or an "example" is not necessarily to be construed as preferred or advantageous over other aspects. Likewise, the term "aspects of the disclosure" does not require that all aspects of the disclosure include the discussed feature, advantage or mode of operation.

Further, as used herein, any reference to "one aspect" or "some aspects" or "an aspect" means that a particular element, feature, structure, or characteristic described in connection with the aspect is included in at least one aspect. The appearances of the phrase "in one aspect" in various places in the specification are not necessarily all referring to the same aspect. Conditional language used herein, such as, among others, "can," "could," "might," "may," "e.g.," and the like, unless specifically stated otherwise, or otherwise understood within the context as used, is generally intended to convey that certain aspects include, while other aspects do not include, certain features, elements and/or steps. In addition, the articles "a" and "an" as used in this application are to be construed to mean "one or more" or "at least one" unless specified otherwise.

As used herein, the terms "comprises," "comprising," "includes," "including," "has," "having" or any other variation thereof, are open-ended terms and intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive "or" and not to an exclusive "or." For example, a condition A or B is satisfied by any one of the following: A is true (or present) and B is false (or not present), A is false (or not present) and B is true (or present), and both A and B are true (or present).

As used herein, a phrase referring to "at least one of" a list of items refers to any combination of those items, including single members. As an example, "at least one of: A, B, or C" is intended to cover: A, B, C, A and B, A and C, B and C, and A, B, and C. Conjunctive language such as the phrase "at least one of X, Y, and Z," unless specifically stated otherwise, is otherwise understood with the context as used in general to convey that an item, term, etc. may be at least one of X, Y, or Z. Thus, such conjunctive language is not generally intended to imply that certain aspects require at least one of X, at least one of Y, and at least one of Z to each be present.

The present disclosure relates to a floating structure for supporting a protective cover placed over a body of water. The disclosed floating support structure includes at least three adjustable-length legs mechanically coupled to a hub. A buoyant floatation device is attached to the terminal end of each leg. The hub is shaped to allow the legs of the floating support structure to move between at least two positions, an open position, in which the floating support structure can float in a body of water by virtue of the flotation devices attached to each leg, and a closed, or collapsed, position, in which the floating support structure can be stowed and stored.

FIG. 1 illustrates an exemplary floating support structure 100 according to at least one aspect of the disclosure. As shown in FIG. 1, the floating support structure 100 includes three legs 104, 106, and 108 terminating in three floatation devices 124, 126, and 128, respectively. In an aspect, each leg 104, 106, and 108 may comprise two or more "telescoping" sections (i.e., a first section having a first diameter slides in and out of a second section having a second, larger, diameter) that allow the length of the leg to be adjusted. The legs 104, 106, and 108 may be set at the desired length by means of locking nuts 114, 116, and 118, respectively, which, when tightened, prevent the multiple sections of the legs 104, 106, and 108 from further movement. Although the legs 104, 106, and 108 are illustrated as having two telescoping sections coupled to each other with one locking nut 114, 116, and 118, as will be appreciated, each leg may have more than two sections and one nut, or may have only one section and no locking nut. Further, although the legs 104, 106, and 108 are illustrated as telescoping legs, as will be appreciated there may be other ways to adjust the length of the legs 104, 106, and 108, such as hinges, slip joints, and the like.

As shown in FIG. 1, in an aspect, the floatation devices 124, 126, and 128 may be able to slide up and down the terminal ends of the legs 104, 106, and 108. This may be beneficial when storing the floating support structure 100. For example, when open, the floatation devices 124, 126, and 128 may be moved down the length of the legs 104, 106, and 108 so that only a small portion of the legs 104, 106, and 108 are within the floatation devices 124, 126, and 128. However, when the floating support structure 100 is closed, to reduce the length of the floating support structure 100, the floatation devices 124, 126, and 128 may be moved up the legs 104, 106, and 108.

As further illustrated in FIG. 1, the floating support structure 100 has an "open" position in which the legs 104, 106, and 108 are separated from each other, resulting in the floating support structure 100 having a "pyramid" shape. The floating support structure 100 also has a "closed" position in which the legs 104, 106, and 108 are brought together for convenient storage. In an aspect, the legs 104, 106, and 108 may be held in the closed position by a stow strap 130. However, as will be appreciated, there are other means of holding the legs 104, 106, and 108 in the closed position, such as plastic clips on the legs 104, 106, and 108, snaps or hook and loop closures on the floatation devices 124, 126, and 128, or the like.

Figure 2:
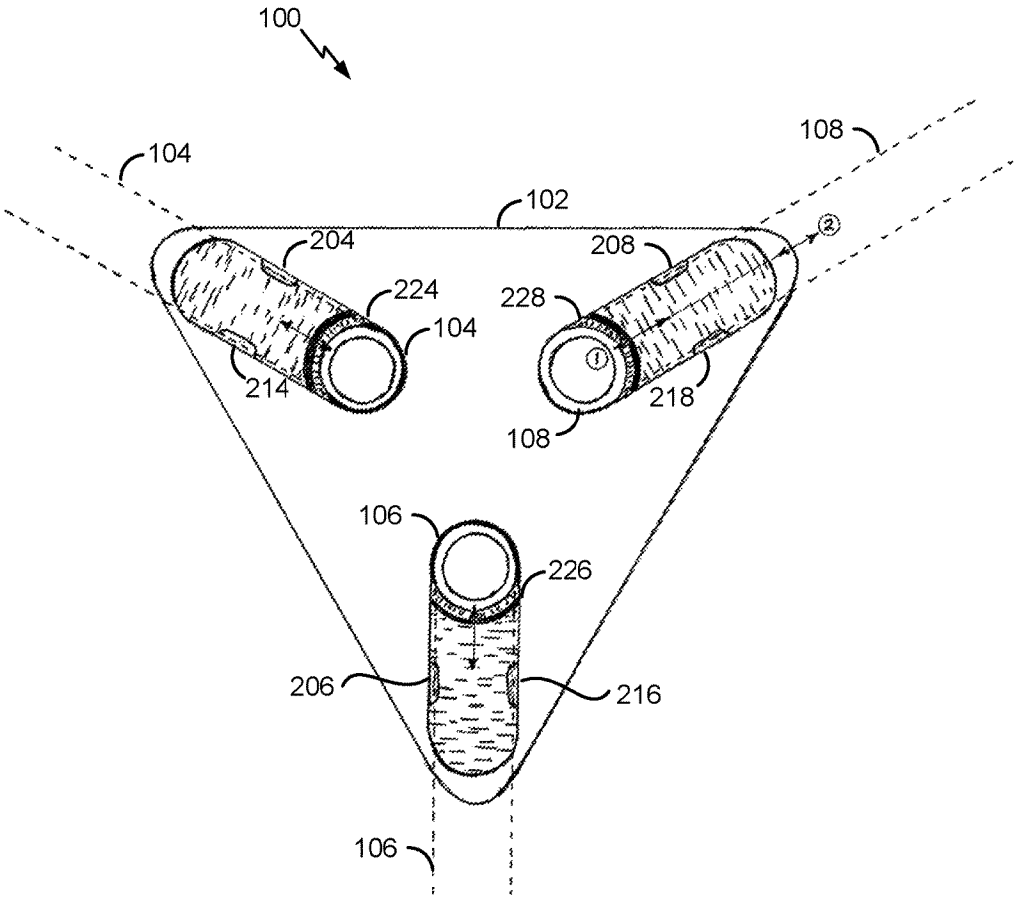
FIG. 2 illustrates a bottom view of the floating support structure of FIG. 1 according to at least one aspect of the disclosure.

FIG. 2 illustrates a bottom view of the floating support structure 100 of FIG. 1 according to at least one aspect of the disclosure. FIG. 2 illustrates the legs 104, 106, and 108 in both the closed (position (1)) and open (position (2)) positions. The arrows in FIG. 2 illustrate the movement of the legs 104, 106, and 108 between the open and closed positions. In the closed position, only the terminal ends of the legs 104, 106, and 108 are visible from the bottom view of the floating support structure 100. As such, each of legs 104, 106, and 108 is illustrated as two concentric circles representing the inside and outside surfaces of the leg (where the legs 104, 106, and 108 are hollow tubes). Note that although the legs 104, 106, and 108 have been illustrated as hollow tubes, they need not be hollow, but rather can be solid.

In an aspect, the coupling between each leg 104, 106, and 108 and the hub 102 may be a ball and socket-type joint, where the end of the leg forms the "ball" and a recess in the hub 102 forms the "socket." In FIG. 2, the socket portion of the hub 102 is illustrated as a half circle and represented by the reference numbers 224, 226, and 228.

The open positions of the legs 104, 106, and 108 are illustrated with dashed lines. As will be described further with reference to FIG. 3, when in the open position, the legs 104, 106, and 108 may be positioned within channels on the bottom side of the hub 102. The legs 104, 106, and 108 may be held in place within these channels by locking tabs 204, 214, 206, 216, 208, and 218, respectively. In an aspect, the locking tabs 204, 214, 206, 216, 208, and 218 may be protrusions on either the hub 102 or the legs 104, 106, and 108 that hold the legs 104, 106, and 108 in place by means of friction. However, as will be appreciated, locking tabs 204, 214, 206, 216, 208, and 218 may not be necessary, and the legs 104, 106, and 108 may instead be held in place by friction between the legs 104, 106, and 108 and the channels in the hub 102 alone. Alternatively, the legs 104, 106, and 108 may be held in place by the weight of gravity and the weight of the protective netting placed over the floating support structure 100.

Figure 3:
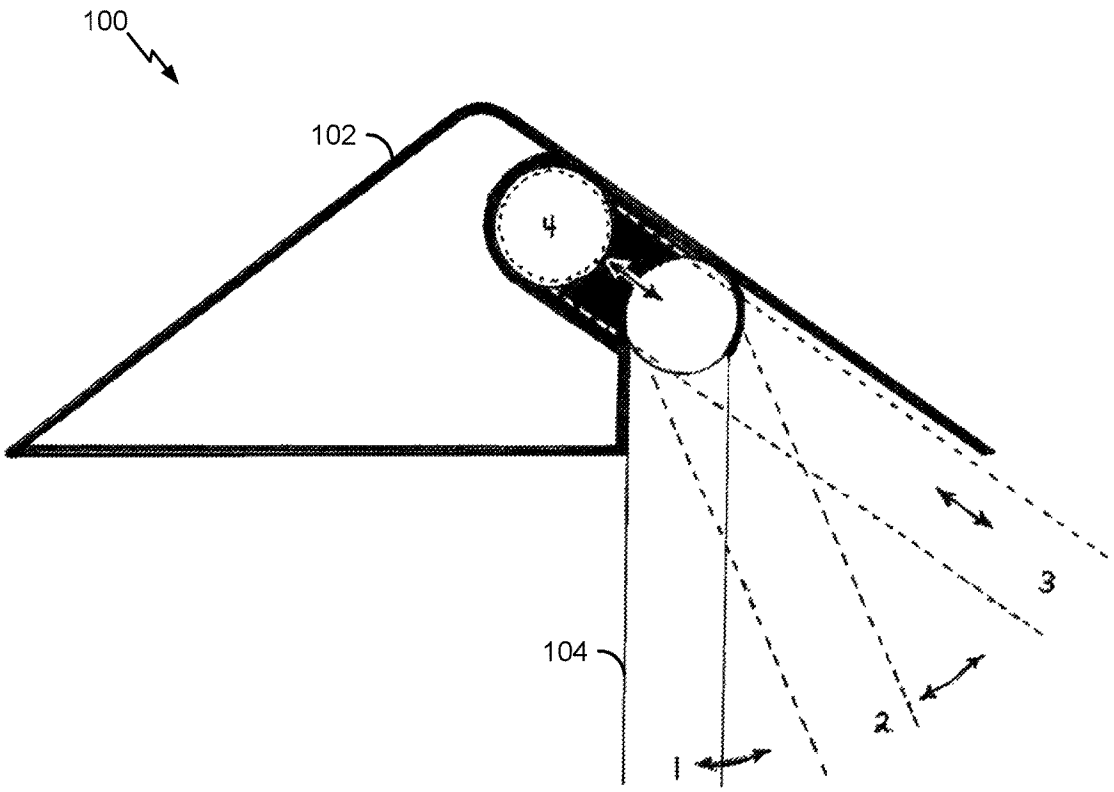
FIG. 3 illustrates a cutaway side view of the floating support structure of FIG. 1 according to at least one aspect of the disclosure.

FIG. 3 illustrates a cutaway side view of the floating support structure 100 of FIG. 1 according to at least one aspect of the disclosure. For simplicity, FIG. 3 illustrates only one of legs 104, 106, and 108, specifically, leg 104. However, the operations of leg 104 described with reference to FIG. 3 are applicable to all legs of the floating support structure 100.

FIG. 3 illustrates four positions of the leg 104, with the arrows in the figure showing the movement of the leg 104. In the first position, in which the leg 104 is illustrated with solid lines, the floating support structure 100 is in the closed position. To move the leg 104 into the open position, the leg 104 swings from the first position through the second position (illustrated with dashed lines) to the third position (illustrated with dashed lines). In the third position, the leg 104 may be positioned within a channel on the bottom side of the hub 102. From the third position, the leg 104 is moved up the channel and further into the hub 102 to the fourth position (illustrated with dashed lines). The leg 104 may be held in the fourth position by locking tabs, such as locking tabs 204, 214, 206, 216, 208, and 218 in FIG. 2. As illustrated by the two-way arrows in FIG. 3, the leg 104 may be moved from the fourth position back to the first position to close the floating support structure 100.

In an aspect, as illustrated in FIG. 3, the top of the hub 102 may have a smooth surface form in order to allow the floating support structure 100 to be slid under a protective netting. More specifically, the protective netting can be anchored around the outside edges of a body of water, and then the floating support structure 100 can be slid under the protective netting and pushed into a preferred location on the body of water.

Figure 4:
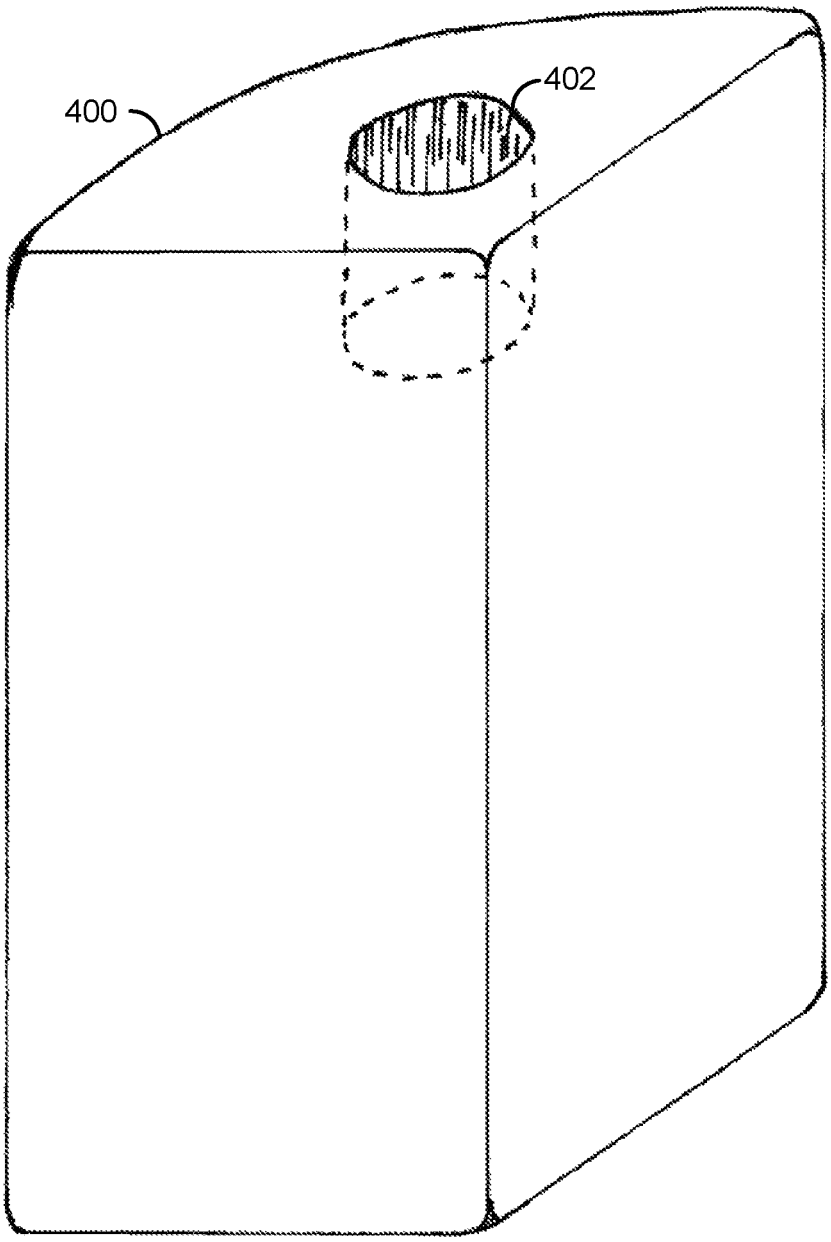
FIG. 4 illustrates an exemplary floatation device according to at least one aspect of the disclosure.

FIG. 4 illustrates an exemplary floatation device 400 according to at least one aspect of the disclosure. The floatation device 400 may correspond to any of floatation devices 124, 126, and 128 in FIG. 1. As illustrated in FIG. 4, the floatation device 400 includes an opening 402 for receiving one of legs 104, 106, and 108. Although FIG. 4 illustrates the opening 402 as only going through a small portion of the floatation device 400, as will be appreciated, the opening 402 may be any depth, and may in some aspects go through the entirety of the floatation device 400. In an aspect, the floatation device 400 may be any buoyant material, such as foam, plastic, and/or wood, and may be hollow or solid.

While a single floating support structure 100 may be deployed on a body of water, in an aspect, multiple floating support structures 100 may be deployed on a body of water, and two or more of the multiple floating support structures 100 may be connected to each other by means of interconnection rods. This is especially beneficial for larger bodies of water, where a single floating support structure 100 may not elevate the protective netting sufficiently to keep all of it out of the water. Thus, the floating support structures 100 of the present disclosure can be used for any size body of water.

Figure 5:
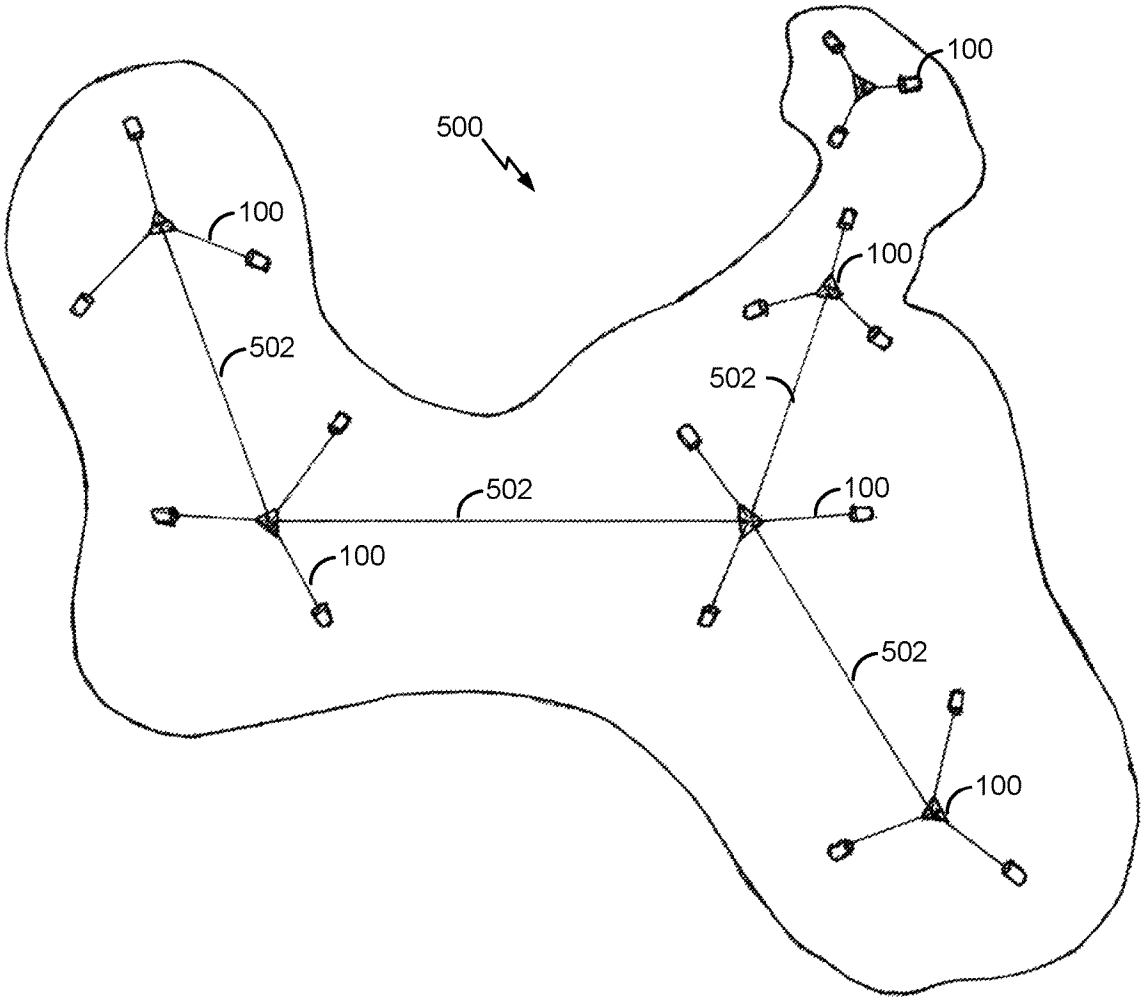
FIG. 5 illustrates an exemplary body of water in which multiple floating support structures have been deployed, according to at least one aspect of the disclosure.

FIG. 5 illustrates an exemplary body of water 500 in which multiple floating support structures 100 have been deployed, according to at least one aspect of the disclosure. As illustrated in FIG. 5, multiple floating support structures 100 within the body of water 500 are connected to each other by means of multiple interconnection rods 502. In an aspect, as shown in FIG. 5, the interconnection rods 502 may have various lengths, dependent on the size and shape of the body of water in which the floating support structures 100 are deployed, here, the body of water 500. The different lengths of the interconnection rods 502 may be due to the interconnection rods 502 being manufactured in different lengths, or due to the interconnection rods 502 having adjustable lengths.

For example, similar to legs 104, 106, and 108, an interconnection rod 502 may include two or more "telescoping" sections (i.e., a first section having a first diameter slides in and out of a second section having a second, larger, diameter) that allow the length of the interconnection rod 502 to be adjusted. The interconnection rod 502 may be set at the desired length by means of one or more locking nuts (depending on the number of telescoping sections) that, when tightened, prevent the multiple sections of the interconnection rod 502 from further movement. As will be appreciated, however, there may be other ways to adjust the length of the interconnection rods 502, such as hinges, slip joints, and the like.

Figure 6:
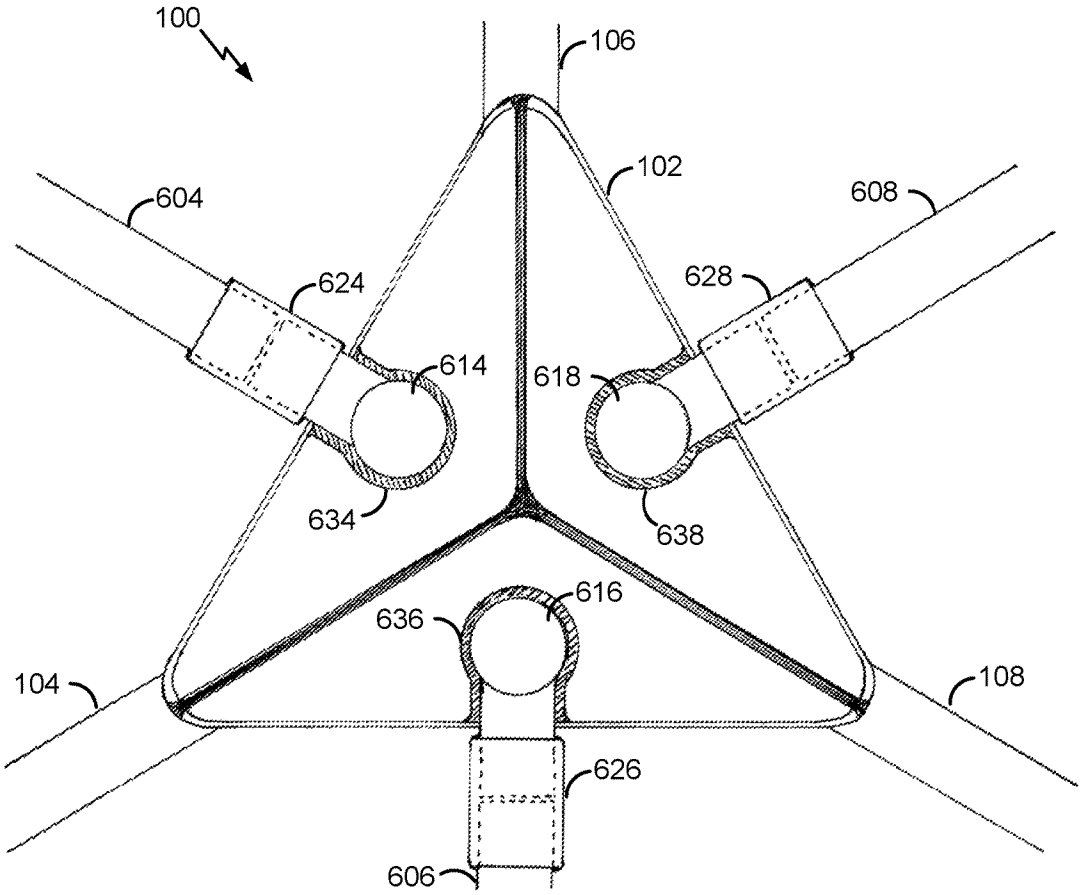
FIG. 6 illustrates a cutaway top view of an exemplary floating support structure of FIG. 1 according to at least one aspect of the disclosure.

FIG. 6 illustrates a cutaway top view of an exemplary floating support structure 100 according to at least one aspect of the disclosure. In the example of FIG. 6, the hub 102 of the floating support structure 100 is illustrated as having three interconnection rods 604, 606, and 608 attached thereto. In an aspect, the connections between the interconnection rods 604, 606, and 608 and the hub 102 may be "ball and socket" connections, and as such, the hub 102 may include multiple "sockets" 634, 636, and 638 for receiving a corresponding number of "ball" joints 614, 616, and 618.

A benefit of using ball and socket-type connections is that the connected floating support structures 100 need not be on the same plane. Rather, as an example, one floating support structure 100 could be positioned at the top of a small waterfall and a connected floating support structure 100 could be positioned below the waterfall. However, as will be appreciated, there are other ways to connect the interconnection rods 604, 606, and 608 to the hub 102, such as slip joints, hinged joints, or the like. Further, although the hub 102 is illustrated as having three sockets 634, 636, and 638 in the example of FIG. 6, as will be appreciated, there may be more or fewer than three such sockets.

In an aspect, the interconnection rods 604, 606, and 608 may be coupled to the ball joints 614, 616, and 618 by means of couplers 624, 626, and 628, respectively. An advantage of using the couplers 624, 626, and 628 is that the couplers 624, 626, and 628 may be part of the hub 102, and interconnection rods of any length can be easily attached to the hub 102 by simply screwing them (e.g., for threaded coupler joints) or pushing them (e.g., for friction coupler joints) into the couplers 624, 626, and 628. However, in another aspect, the terminal ends of the interconnection rods 604, 606, and 608 may form the ball joints 614, 616, and 618, and couplers 624, 626, and 628 may be eliminated.

Figure 7:
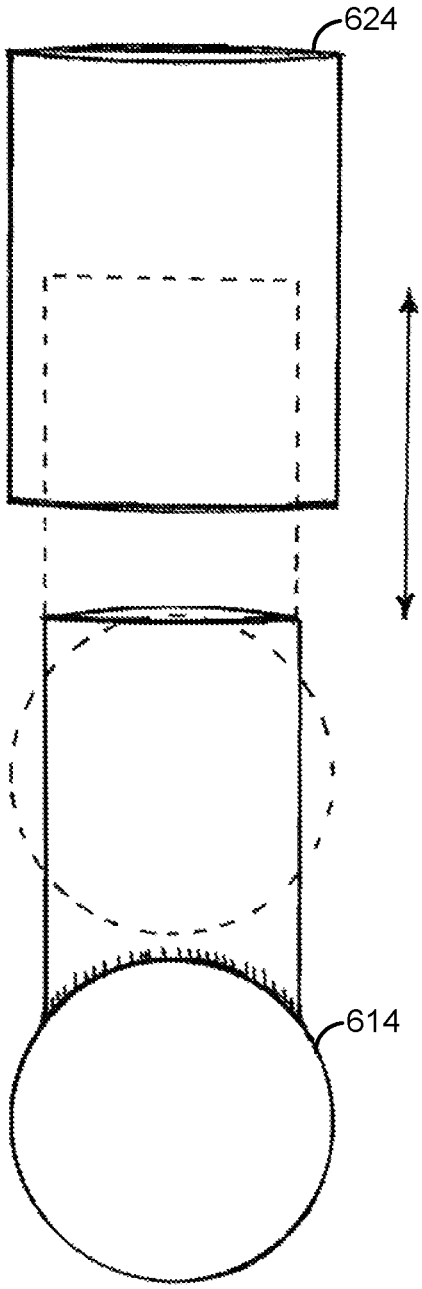
FIG. 7 illustrates an exemplary coupler and ball joint according to at least one aspect of the disclosure.

FIG. 7 illustrates an exemplary coupler and ball joint according to at least one aspect of the disclosure. For simplicity, FIG. 7 illustrates only one of couplers 624, 626, and 628, specifically, coupler 624, and one of ball joints 614, 616, and 618, specifically, ball joint 614. However, the description of the coupler 624 and the ball joint 614 with reference to FIG. 7 is applicable to all couplers of the hub 102.

As shown in FIG. 7, the ball joint 614 and the coupler 624 may form a "slip" joint, in which the ball joint 614 is retained within the coupler 624 by means of friction. The movement of the ball joint 614 into the coupler 624 is illustrated by the arrow and dashed outline of the ball joint 614.

Figure 8:
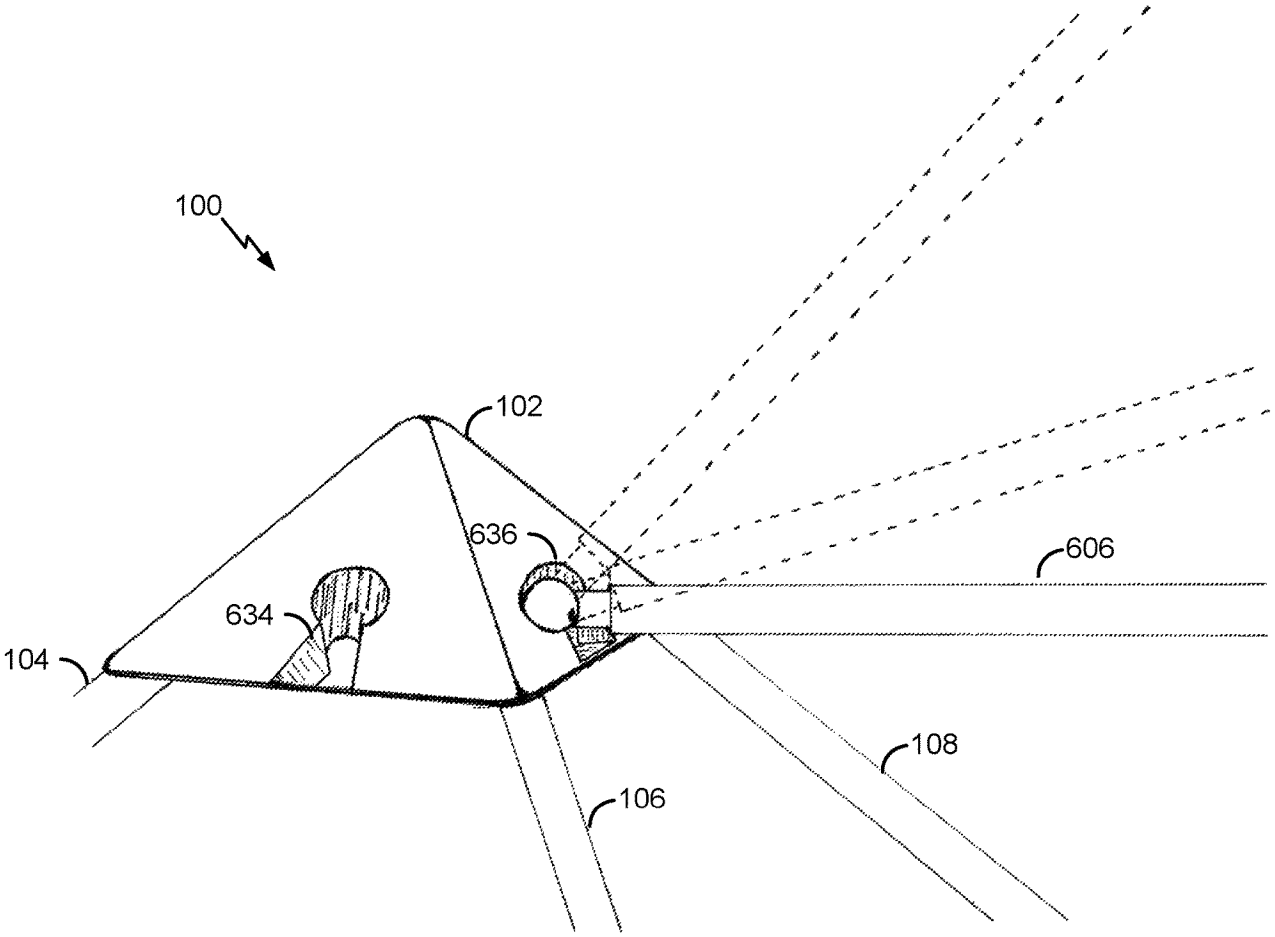
FIG. 8 illustrates an exemplary perspective view of the floating support structure of FIG. 1 according to at least one aspect of the disclosure.

FIG. 8 illustrates an exemplary perspective view of floating support structure 100 according to at least one aspect of the disclosure. In the example of FIG. 8, the hub 102 is illustrated as having "sockets" for receiving interconnection rods. Specifically, the hub 102 includes at least the sockets 634 and 636 illustrated in FIG. 6. Further, interconnection rod 606 has been placed in socket 636. As illustrated by the dashed lines, because the terminal end of the interconnection rod 606 is a ball joint (which, although not illustrated in FIG. 8, may be the ball joint 616 and coupler 626 in FIG. 6), the interconnection rod may be oriented at different angles relative to the hub 102, while still securely held in place by the socket 636. As noted above with reference to FIG. 6, this permits connected floating support structures 100 to be on different planes, such as at the top of a small waterfall and below the waterfall.

Figure 9A:
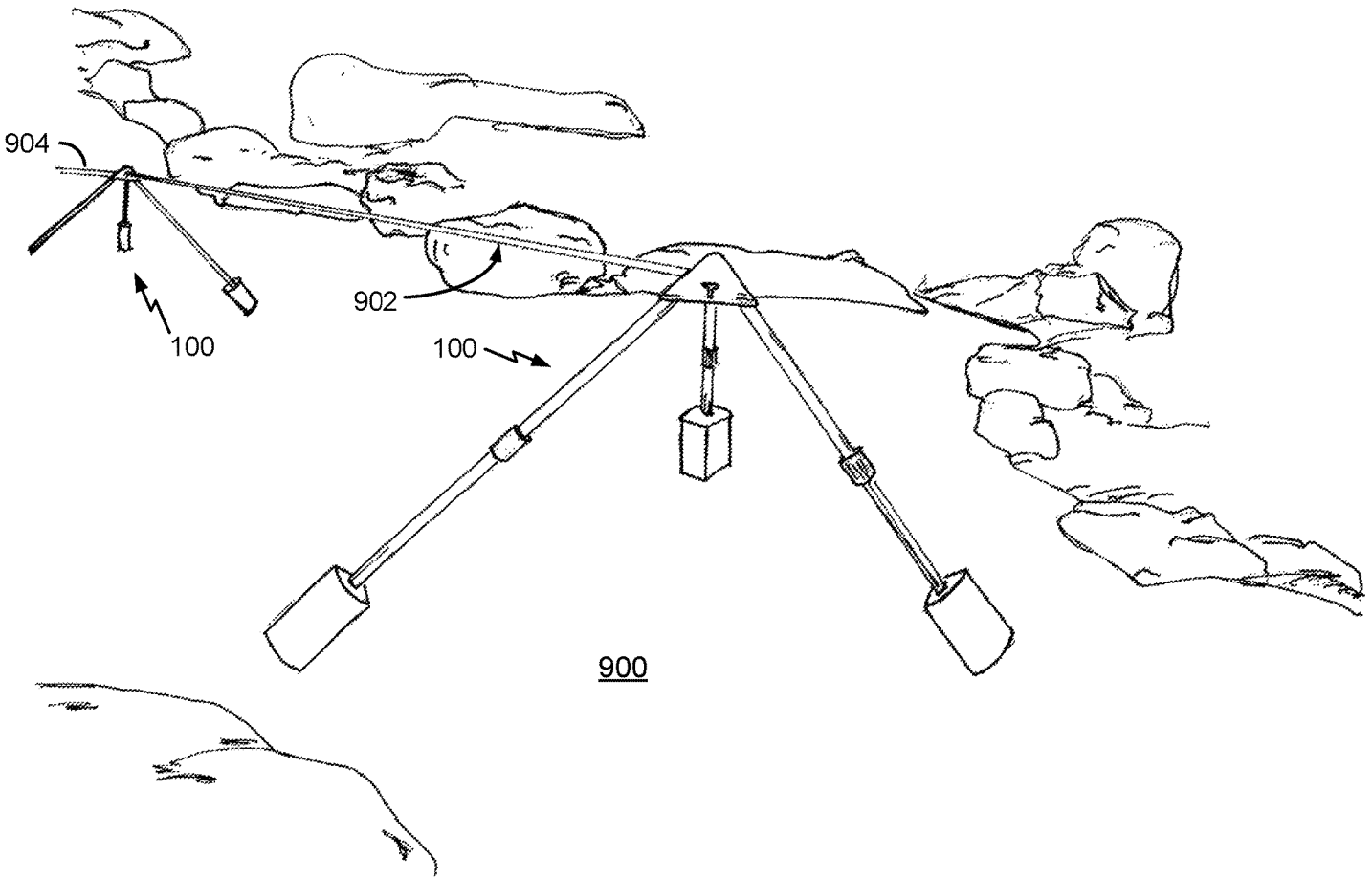
FIGS. 9A and 9B illustrate an exemplary deployment of multiple interconnected floating support structures over a body of water, according to at least one aspect of the disclosure.
Figure 9B:
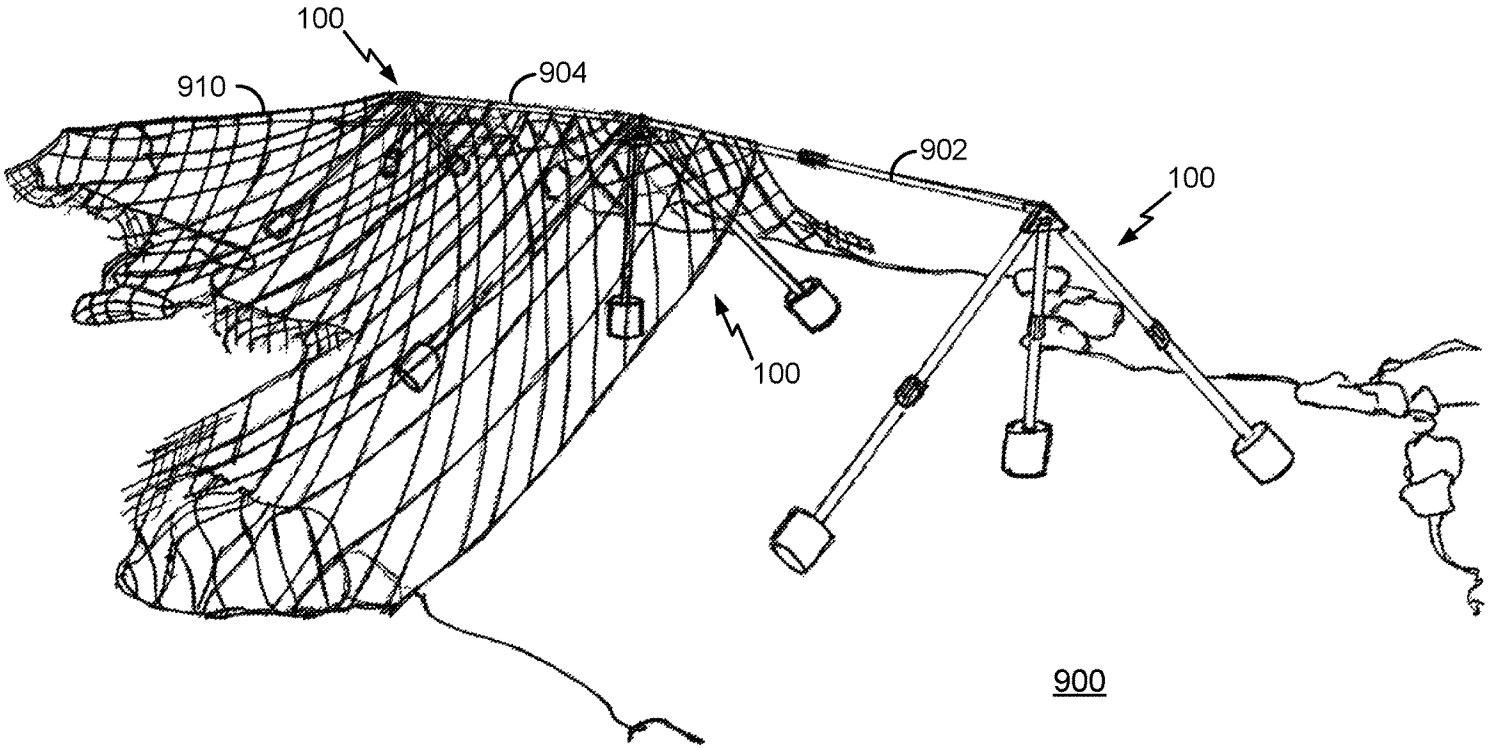

FIGS. 9A and 9B illustrate an exemplary deployment of multiple interconnected floating support structures 100 over a body of water 900, according to at least one aspect of the disclosure. As illustrated in FIG. 9A, two floating support structures 100 are connected to each other by an interconnection rod 902. A second interconnection rod 904 connects the two floating support structures 100 to a third floating support structure 100 (not shown). As shown in FIG. 9B, a protective netting 910 is being stretched over the three floating support structures 100 (connected by interconnection rods 902 and 904) and anchored to the edges of the body of water 900. As will be appreciated, it is far more convenient to deploy several floating support structures 100 onto a body of water (e.g., body of water 900), optionally attached by interconnection rods, than to assemble a frame over the body of water that must have its legs on the ground outside the body of water, as is conventionally done.

Note that although FIG. 9B illustrates the protective netting 910 being stretched over the floating support structures 100, an alternative is to first anchor the edges of the protective netting 910 to the edges of the body of water 900 and then to deploy the floating support structures 100 (and interconnection rods 902 and 904 if desired) under the protective netting 910. This may allow the protective netting 910 to be stretched more tightly over the body of water 900, thereby reducing slack in the protective netting 910 that may be more likely to collect debris.

Figure 10:
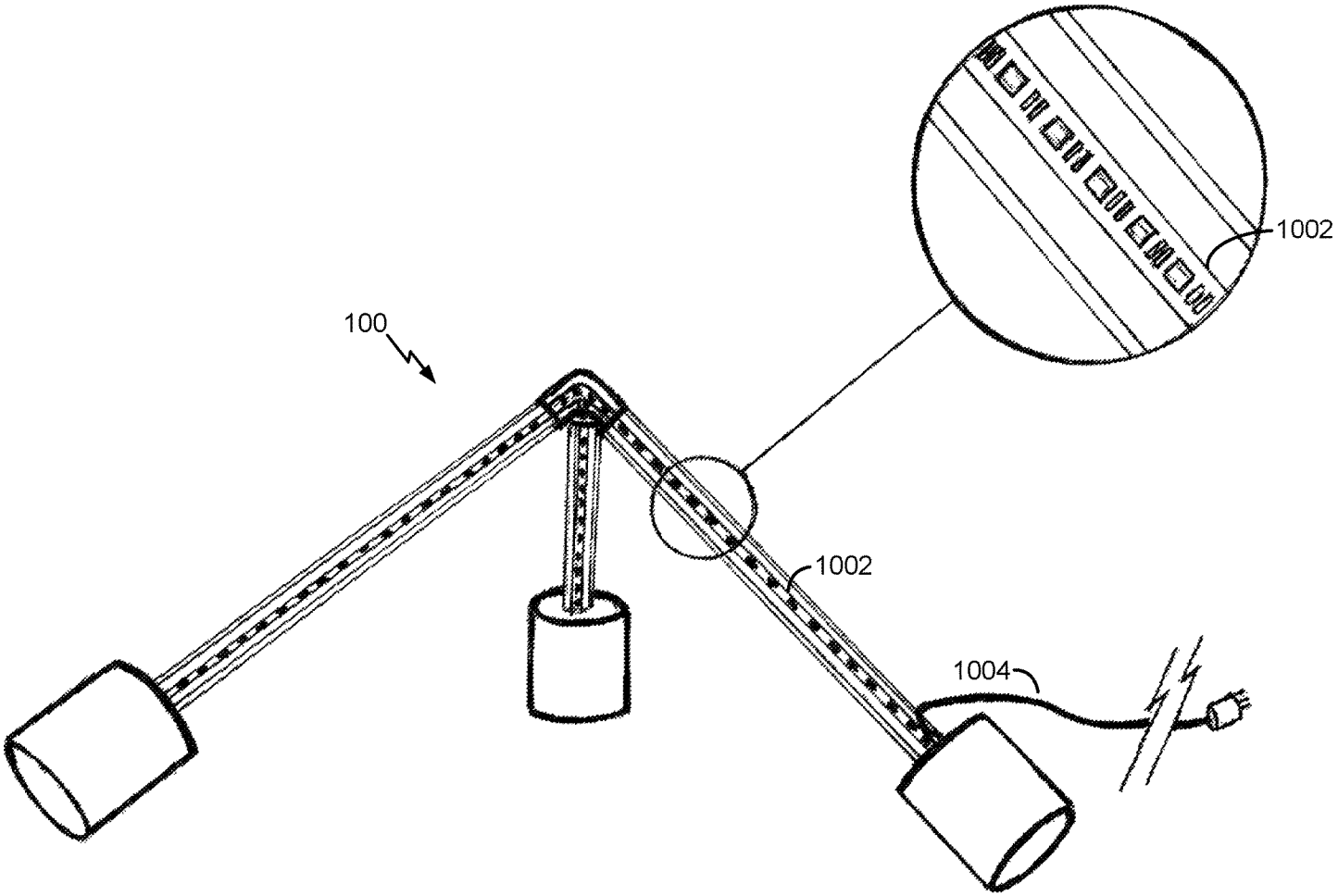
FIG. 10 illustrates an exemplary floating support structure that has been wired with light emitting diode (LED) lights, according to at least one aspect of the disclosure.

The floating support structures 100 disclosed herein may be used for purposes other than or in addition to the support of protective netting. For example, FIG. 10 illustrates an exemplary floating support structure 100 that has been wired with light emitting diode (LED) lights 1002, according to at least one aspect of the disclosure. In the example of FIG. 10, the legs of the floating support structure 100 may be a transparent (or semi-transparent) polymer, such that when the LED lights 1002 are turned on, the legs glow with the color of the LED lights 1002. A power cord 1004 attached to one end of the LED lights 1002 enables the LED lights 1002 to be plugged in to a nearby outlet or extension cord.

In other aspects, items may be hung from the hub or legs of a floating support structure 100, such as planters, fish feeders, decorations, and the like. Further, aeration devices may be placed in the terminal ends of the legs of a floating support structure 100 to aerate the water as the floating support structure 100 floats in a body of water.

Further, although the exemplary floating support structure 100 has been illustrated as having three legs, as will be appreciated, it may have more than three legs. Additionally, while the foregoing disclosure has described the exemplary floating support structure 100 as supporting a protective netting, as will be appreciated, it could support any type of cover for a body of water. Further still, although the foregoing has described the exemplary floating support structure 100 as being deployed on a body of water such as a pond or other landscaping water feature, as will be appreciated, the floating support structure 100 could be deployed on any body of water where it is desired to support some sort of cover, such as a swimming pool, hot tub, or the like.

Accordingly, while the foregoing disclosure shows various illustrative aspects, it should be noted that various changes and modifications may be made to the illustrated examples without departing from the scope defined by the appended claims. The present disclosure is not intended to be limited to the specifically illustrated examples alone. For example, unless otherwise noted, the functions, steps, and/or actions of the method claims in accordance with the aspects of the disclosure described herein need not be performed in any particular order. Furthermore, although certain aspects may be described or claimed in the singular, the plural is contemplated unless limitation to the singular is explicitly stated.

What is claimed is:

1. A floating support structure for supporting a cover of a body of water, comprising:

at least three legs, each leg of the at least three legs having a first terminal end and a second terminal end opposite the first terminal end;

a hub coupled to the first terminal end of each leg of the at least three legs, wherein the hub comprises at least three channels, wherein each channel of the at least three channels is configured to receive a leg of the at least three legs, wherein the floating support structure is configured in an open position based on the at least three legs being positioned within the at least three channels, and wherein the floating support structure is configured in a closed position based on the at least three legs being positioned outside of the at least three channels; and at least three floatation devices, wherein each floatation device of the at least three floatation devices is coupled to the second terminal end of a leg of the at least three legs.

2. The floating support structure of claim 1, wherein the hub is configured to allow the at least three legs to move between the open position and the closed position of the floating support structure.

3. The floating support structure of claim 1, wherein the floating support structure is configured to float in the body of water when in the open position, and wherein the floating support structure is configured to be stored when in the closed position.

4. The floating support structure of claim 1, wherein the at least three legs are held within the at least three channels by friction between the at least three legs and the at least three channels, by locking tabs, by a weight of the cover, or by any combination thereof.

5. The floating support structure of claim 1, wherein the at least three legs are held in the closed position of the floating support structure by a stow strap.

6. The floating support structure of claim 1, wherein each leg of the at least three legs comprises at least two sections coupled together that permit a length of the leg to be adjusted.

7. The floating support structure of claim 1, wherein the hub is configured to receive a terminal end of at least one interconnection rod, wherein the at least one interconnection rod is configured to couple the floating support structure to a second floating support structure.

8. The floating support structure of claim 7, wherein the terminal end of the at least one interconnection rod comprises a ball joint, and wherein the hub being configured to receive the terminal end of the at least one interconnection rod comprises the hub having a socket configured to receive the ball joint of the terminal end of the at least one interconnection rod.

9. The floating support structure of claim 7, wherein the hub being configured to receive the terminal end of the at least one interconnection rod comprises the hub having a socket formed therein and a ball joint coupled to the socket, and wherein the terminal end of the at least one interconnection rod is coupled to the ball joint.

10. A hub of a floating support structure for supporting a cover of a body of water, comprising:

a top surface configured to support the cover of the body of water;

a bottom surface configured to receive a first terminal end of each leg of at least three legs; and at least three channels, each channel of the at least three channels having an opening in the bottom surface of the hub, wherein each channel of the at least three channels is configured to receive a leg of the at least three legs, wherein the hub is configured to allow the at least three legs to move between an open position and a closed position of the floating support structure, and wherein the hub is configured to receive a terminal end of at least one interconnection rod, wherein the at least one interconnection rod is configured to couple the floating support structure to a second floating support structure.

11. The hub of claim 10, wherein the at least three legs are held in the open position of the floating support structure based on being positioned within the at least three channels.

12. The hub of claim 11, wherein the at least three legs are held within the at least three channels by friction between the at least three legs and the at least three channels, by locking tabs, by a weight of the cover, or by any combination thereof.

13. The hub of claim 10, wherein the terminal end of the at least one interconnection rod comprises a ball joint, and wherein the hub being configured to receive the terminal end of the at least one interconnection rod comprises the hub having a socket configured to receive the ball joint of the terminal end of the at least one interconnection rod.

14. The hub of claim 10, wherein the hub being configured to receive the terminal end of the at least one interconnection rod comprises the hub having a socket formed therein and a ball joint coupled to the socket, and wherein the terminal end of the at least one interconnection rod is coupled to the ball joint.

15. The hub of claim 10, wherein the openings of the at least three channels are positioned at equal distances from each other along an outside edge of the bottom surface of the hub.

16. A hub of a support structure for supporting a cover, comprising:

a top surface configured to support the cover;

a bottom surface configured to receive a first terminal end of each leg of at least three legs; and at least three channels, each channel of the at least three channels having an opening in the bottom surface of the hub, wherein each channel of the at least three channels is configured to receive a leg of the at least three legs, wherein the hub is configured to allow the at least three legs to move between an open position and a closed position of the support structure, and wherein the hub is configured to receive a terminal end of at least one interconnection rod, wherein the at least one interconnection rod is configured to couple the support structure to a second support structure.

17. The hub of claim 16, wherein the at least three legs are held in the open position of the support structure based on being positioned within the at least three channels.

18. The hub of claim 17, wherein the at least three legs are held within the at least three channels by friction between the at least three legs and the at least three channels, by locking tabs, by a weight of the cover, or by any combination thereof.

19. The hub of claim 16, wherein the terminal end of the at least one interconnection rod comprises a ball joint, and wherein the hub being configured to receive the terminal end of the at least one interconnection rod comprises the hub having a socket configured to receive the ball joint of the terminal end of the at least one interconnection rod.

20. The hub of claim 16, wherein the hub being configured to receive the terminal end of the at least one interconnection rod comprises the hub having a socket formed therein and a ball joint coupled to the socket, and wherein the terminal end of the at least one interconnection rod is coupled to the ball joint.

* * * * *